US006504516B1

(12) United States Patent
Davis

(10) Patent No.: US 6,504,516 B1
(45) Date of Patent: Jan. 7, 2003

(54) HEXAGONAL ARRAY ANTENNA FOR LIMITED SCAN SPATIAL APPLICATIONS

(75) Inventor: Daniel Davis, Baltimore, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 12 days.

(21) Appl. No.: 09/908,803

(22) Filed: Jul. 20, 2001

(51) Int. Cl.[7] ..... H01Q 21/00

(52) U.S. Cl. ..... 343/853; 343/844; 342/368; 455/12.1

(58) Field of Search ..... 343/844, 813, 343/893, 754; 342/368, 371, 354; 455/12.1, 13.3

(56) References Cited

U.S. PATENT DOCUMENTS

| | | | | | |
|---|---|---|---|---|---|
| 5,648,784 | A | * | 7/1997 | Benedicto et al. | 342/372 |
| 5,790,070 | A | * | 8/1998 | Natarajan et al. | 342/354 |
| 5,812,088 | A | * | 9/1998 | Pi et al. | 342/373 |
| 5,856,804 | A | * | 1/1999 | Turcotte et al. | 342/371 |
| 6,018,316 | A | * | 1/2000 | Rudish et al. | 342/361 |
| 6,157,811 | A | * | 12/2000 | Dent | 455/12.1 |
| 6,307,507 | B1 | * | 10/2001 | Gross et al. | 342/354 |
| 6,340,948 | B1 | * | 1/2002 | Munoz-Garcia et al. | 342/354 |
| 6,380,893 | B1 | * | 4/2002 | Chang et al. | 342/157 |
| 6,388,615 | B1 | * | 5/2002 | Chang et al. | 342/354 |
| 6,404,404 | B1 | * | 6/2002 | Chen et al. | 343/844 |

OTHER PUBLICATIONS

"Digital Beamforming Antenna", Microwave Journal, Euro-global Edition, Jan. 1987, vol. 30, No. 1, pp. 107–108, 110, 112, 114, 116, 118, 120, 122, 124.

* cited by examiner

*Primary Examiner*—Don Wong
*Assistant Examiner*—Shih-Chao Chen
(74) *Attorney, Agent, or Firm*—Birch, Stewart, Kolasch & Birch, LLP

(57) ABSTRACT

Ninety-one elements are arranged in a phased array of five concentric hexagonal rings about a center element and are connected so as to form nineteen hexagonal sub-arrays of seven dipole elements each and where every second interior element is coincident with a digital beam forming input/output port connected to an adjacent seven sub-aperture feed ports. The center element of each hexagonal sub-array and the elements in the outermost hexagonal ring are fed from one sub-aperture feed port while the interior elements surrounding respective center elements are fed from one sub-aperture feed port of two adjacent input/output ports by way of an element containing a signal combiner. Moreover, the center element of a sub-aperture feed has twice the power as surrounding elements of the sub-aperture. A digital beam former (DBF) is used as an input on transmit or output on receive to produce proper amplitudes and phases to steer the antenna and generate overlapping beams.

21 Claims, 3 Drawing Sheets

FIG.4
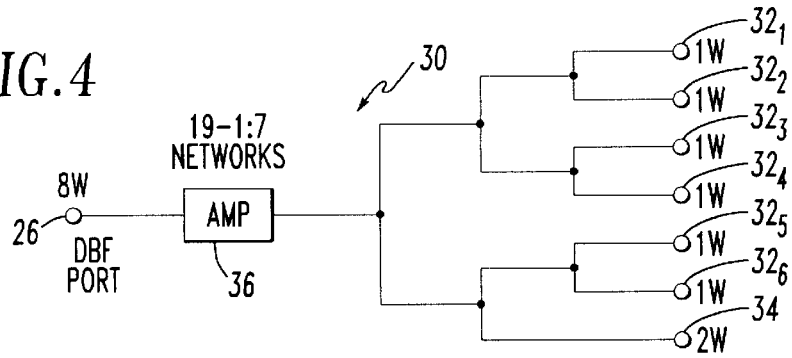
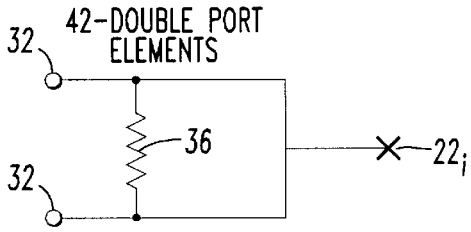
FIG.5
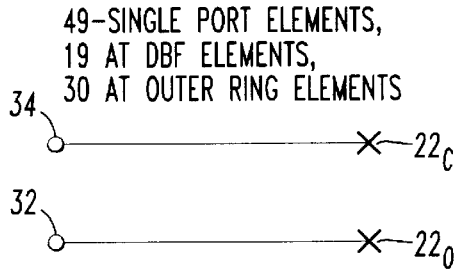
FIG.6
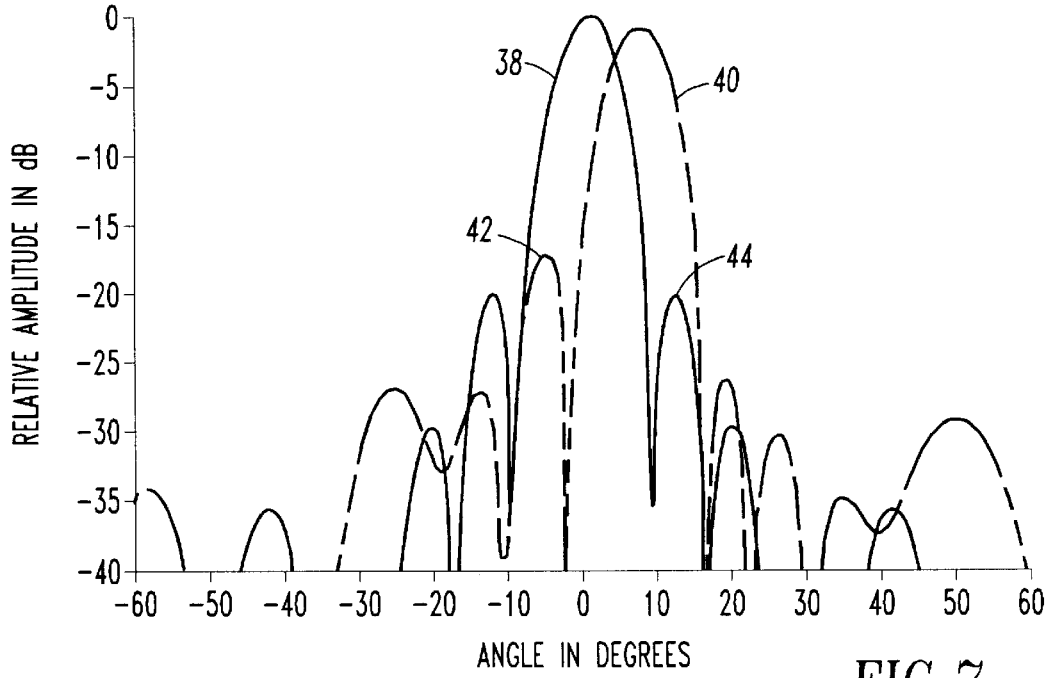
FIG.7

HEXAGONAL ARRAY ANTENNA FOR LIMITED SCAN SPATIAL APPLICATIONS

BACKGROUND OF THE INVENTION

1. Field of the Invention

This invention relates generally to array type antennas for transmitting and receiving RF energy at UHF frequencies, and more particularly to a hexagonal array antenna for limited scan spatial applications with triangular grid and overlapped sub-apertures.

2. Description of Related Art

There is a need for an antenna for a Mobile User's Objective System (MUOS) which is a spatial communication system featuring transmit and receive antenna operation at frequencies in the UHF portion of the RF spectrum. Typically this type of requirement is fulfilled with a multi-beam offset parabolic reflector. The reflector has a mesh surface and is deployed in space. Such antennas are typically 9.6 and 11.4 meters in diameter and produce 7–7.2° beam-width beams in a concentric formation. The problem associated with such apparatus is to produce a deployable system having limited scan but one that can be steered. Such antennas normally have many controls that make this difficult.

SUMMARY

Accordingly, it is an object of the present invention to provide an improvement in a phased array antenna.

It is another object of the invention to provide a phased array antenna which can be deployed in space and steered over a limited field of view.

It is yet another object of the invention to provide a deployable phased array antenna system which provides scan control with an improved circuit configuration with a minimal number of controlled feed points.

The foregoing and other objects are achieved by a phased array in the form of a triangular grid of steerable antenna elements arranged in a plurality of concentric rings and which include a plurality of digital beam forming input/output ports which are substantially less in number than the total number of antenna elements, wherein each port comprises a feed point for a respective set of mutually adjacent antenna elements including a center element and a plurality of elements which surround and form a concentric ring around the center element so as to define a plurality of sub-arrays, wherein the elements of each sub-array are selectively connected and fed from input/output ports of said plurality of input/output ports so as to provide a plurality of overlapped sub-apertures, and wherein the sub-apertures are activated and controlled to generate a respective number of overlapped beams.

In a preferred embodiment, ninety-one elements are arranged in a phased array of five concentric hexagonal rings about a center element and are connected so as to form nineteen hexagonal sub-arrays of seven dipole elements each and where every second interior element is coincident with a digital beam forming input/output port connected to seven sub-aperture feed ports. The center element of each hexagonal sub-array and the elements in the outermost hexagonal ring are fed from one sub-aperture feed port while the interior elements surrounding respective center elements are fed from one sub-aperture feed port of two adjacent input/output ports by way of a signal divider element. Moreover, the center element of a sub-aperture feed has twice the power as surrounding elements of the sub-aperture A digital beam former (DBF) is used as an input on transmit or output on receive to produce proper amplitudes and phases to steer the antenna and generate overlapping beams.

Further scope of applicability of the present invention will become apparent from the detailed description provided hereinafter. It should be understood, however, that the detailed description and specific example, while disclosing the preferred embodiment of the invention, it is given by way of illustration only, since various changes and modifications coming within the spirit and scope of the invention will become apparent to those skilled in the art from the detailed description.

BRIEF DESCRIPTION OF THE DRAWINGS

The present invention will become more fully understood when considered in conjunction with the accompanying drawings which are provided by way of illustration only, and thus are not meant to be considered in a limiting sense, and wherein:

FIG. 4 is an electrical schematic diagram illustrative of the circuit configuration connecting one DBF port to seven elements of a sub-array;

FIG. 5 is an electrical schematic diagram illustrative of a single antenna element connected to two DBF ports;

FIG. 6 is an electrical schematic diagram illustrative of an antenna element connected to a single DBF port;

FIG. 7 is a diagram illustrative of the boresight and scanned antenna patterns of the phased array shown in FIG. 3;

DETAILED DESCRIPTION OF THE INVENTION

Figure 1:
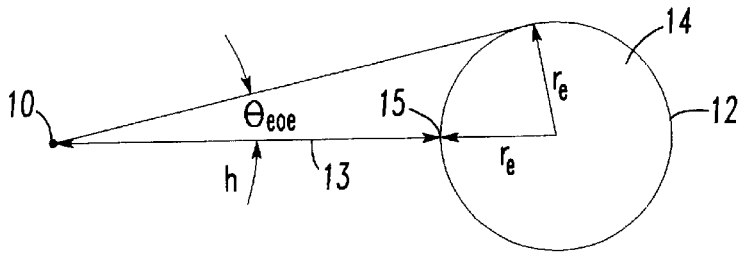
FIG. 1 is a geometrical diagram illustrative of the relationship between the earth and a phased array antenna deployed in outer space.

Considering now the drawings wherein like reference numerals refer to like elements, reference is first made to FIG. 1 which geometrically depicts the relationship of a spaceborne scanning antenna 10 of, for example, a Mobile User's Objective System (MUOS) located in space at a distance h, for example, 35,868 km above the surface 12 of the earth 14, shown in FIG. 1 having an earth radius of $r_e$. Reference numeral 15 represents the nadir, which is the point on the earth 14 directly below the antenna 10. The line 13 can be considered the "boresight" or the center of scan of the antenna 10. At such a distance, only a small cone angle $\theta_{eoe}$ of ±8.7° is required to scan the face of the earth 14.

Figure 2:
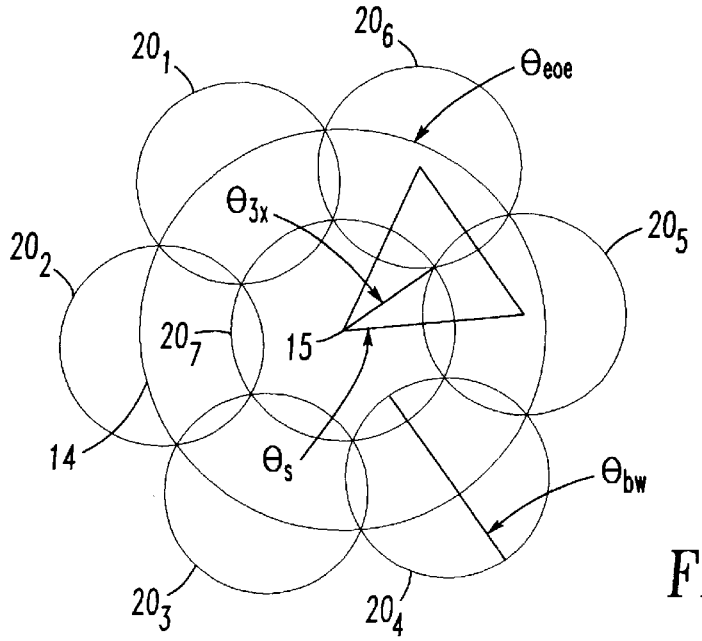
FIG. 2 is a diagram illustrative of a spatial beam formation provided by the subject invention.

It can be seen with respect to FIG. 2 that for a MUOS antenna system located in high earth orbit it can produce circular beams having a beamwidth $\theta_{bw}$ of, for example 7.24°. Accordingly, seven overlapping scanned beams $\mathbf{20}_1$, $\mathbf{20}_2$ . . . $\mathbf{20}_7$ can cover one half of the face of the earth 12. The dimension $\theta_s$ in FIG. 2 is 7.53°, while the dimension $\theta_{3X}$ is 4.35° and denotes the scan angle between one beam and three adjacent overlapping beams.

In the subject invention, beams such as shown in FIG. 2 are generated and steered by a phased array of ninety one dipole antenna elements $\mathbf{22}_1 \ldots \mathbf{22}_{91}$ controlled by digital beam forming (DBF) apparatus, not shown, and which is used to set either the transmit or receive amplitude and phase distributions. The concept of digital beam forming is well known and is taught, for example, in a publication entitled "Digital Beamforming Antenna", H. Steyskal, *Microwave Journal*, Euroglobal Edition, January, 1987, Vol. 30, No. 1, page 107.

Figure 3:
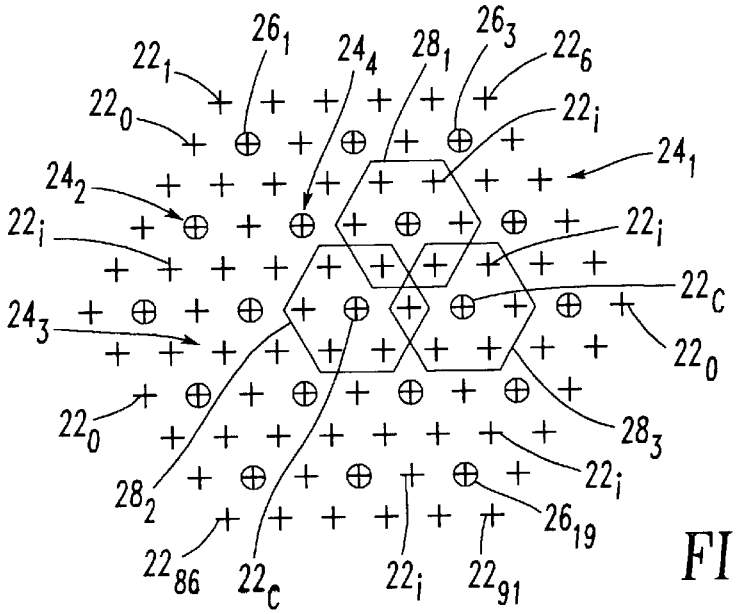
FIG. 3 is a diagram illustrative of the preferred embodiment of the subject invention.

The ninety one antenna elements $\mathbf{22}_1 \ldots \mathbf{22}_{91}$ are arranged in a triangular gird as shown in FIG. 3 in five concentric hexagonal rings $\mathbf{24}_1 \ldots \mathbf{24}_5$. Nineteen digital beam forming (DBF) input/output ports $\mathbf{26}_1 \ldots \mathbf{26}_{19}$, indicated by circles around the element 22, define nineteen feed points which feed nineteen hexagonal sub-arrays $\mathbf{28}_1 \ldots \mathbf{28}_{19}$ which implement respective sub-apertures, three of which $\mathbf{28}_1$, $\mathbf{28}_2$ and $\mathbf{28}_3$ are shown in FIG. 3 simply for purposes of explanation. Each sub-array 28 consists of seven antenna elements, one of these elements $\mathbf{22}_c$ being a center element and the other six elements $\mathbf{22}_i$ or $\mathbf{22}_0$ being located around the center element $\mathbf{22}_c$ in a hexagonal ring. Element $\mathbf{22}_i$ represents an interior element in the inner rings $\mathbf{24}_2 \ldots \mathbf{24}_5$, while element $\mathbf{22}_o$ represents an element in the outermost ring $\mathbf{24}_2$.

All of the elements $\mathbf{22}_1 \ldots \mathbf{22}_{91}$, are simultaneously active, with digital beam former (DBF) control being used during transmit and receive modes to provide the requisite amplitudes and phases for generating overlapping circular beams $\mathbf{20}_1 \ldots \mathbf{20}_7$ shown in FIG. 2.

Considering now FIGS. 4–6 which disclose the details of the feed circuitry, FIG. 4 indicates that each of the DBF input/output ports $\mathbf{26}_1 \ldots \mathbf{26}_{19}$ are connected to respective 1:7 feed networks 30 which include six sub-aperture feed ports $\mathbf{32}_1 \ldots \mathbf{32}_6$ of a first power level and a single sub-aperture feed port 34 of twice the first power level. A buffer amplifier 36 is shown located between the DBF port 26 and the seven feed ports. Thus, for example, if 8 watts appear at DBF port 26, 1 watt of power will appear at the six low power level sub-aperture feed ports $\mathbf{32}_1 \ldots \mathbf{32}_6$, while 2 watts of power will appear at the centered seventh sub-aperture feed port 34.

The interior elements $\mathbf{22}_i$ located around the center antenna element $\mathbf{22}_c$ in each sub-array 28 in the inner hexagonal rings $\mathbf{24}_2 \ldots \mathbf{24}_5$ (FIG. 3) are fed from two adjacent low power (1 watt) sub-aperture feed ports, for example, ports $\mathbf{32}_1$ and $\mathbf{32}_2$. The interior antenna elements $\mathbf{22}_i$ share the signal coming to or from two adjacent feed ports 32 of respective DBF input/output ports 26 via a signal divider element 36 as shown in FIG. 5. With respect to the outer elements $\mathbf{22}_o$ in the outermost hexagonal ring $\mathbf{24}_1$ they are fed by a single low power (1 watt) sub-aperture port 32 of the closest DBF port 26 as shown in FIG. 6 while the center elements $\mathbf{32}_c$ are fed from the high power (2 watt) sub-aperture feed port 34 also shown in FIG. 6.

Thus in the triangular grid of elements $\mathbf{22}_1 \ldots \mathbf{22}_{91}$ as shown in FIG. 3, every second element 22 is located at a DBF port 26. Each DBF port 26 feeds a center sub-aperture feed port 34 and six adjacent sub-aperture feed ports $\mathbf{32}_1 \ldots \mathbf{32}_6$ of one or two sub-arrays 28. Elements 22 in between these DBF ports are fed from adjacent DBF ports, thus the sub-apertures overlap.

Normally the controlled feed points i.e. the DBF ports $\mathbf{26}_1 \ldots \mathbf{26}_{19}$, being located two antenna elements 22 apart, will cause grating lobes to be generated where the distance between the antenna elements are equal to or greater than one half wavelength ($\lambda/2$). However, since an antenna element 22 intermediate to any two feed points 26 is fed from both sides by adjacent DBF ports, its phase is correct when scanned.

As shown in FIG. 7, two antenna patterns are shown where the solid lines represent the boresight antenna pattern for a 9.6 m array operating at 305 MHz, while the dotted line represents the antenna pattern for a 7.5° scan of the scan array. Scan loss of 0.8 dB is shown between the boresight and scanned beam patterns 38 and 40 which is reasonable and acceptable. A slight taper of 4.7 dB is applied hereto to achieve −17 dB scan sidelobes 42 as compared with −20 dB boresight sidelobe 44.

Figure 8:
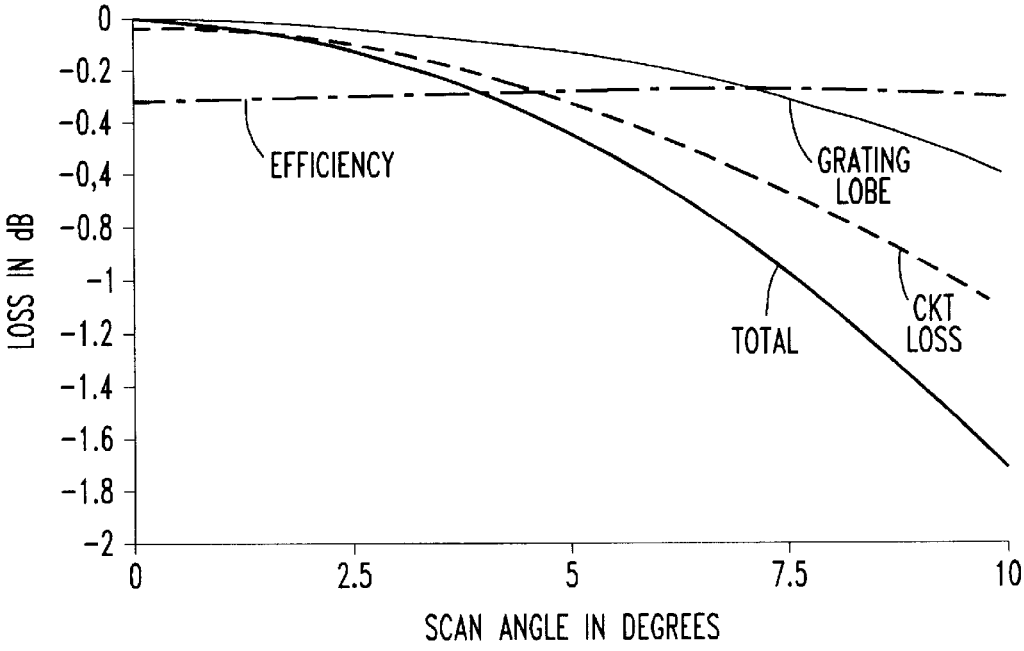
FIG. 8 is a diagram illustrative of scan losses for scanning the hexagon array shown in FIG. 3 towards the points of the hexagon.
Figure 9:
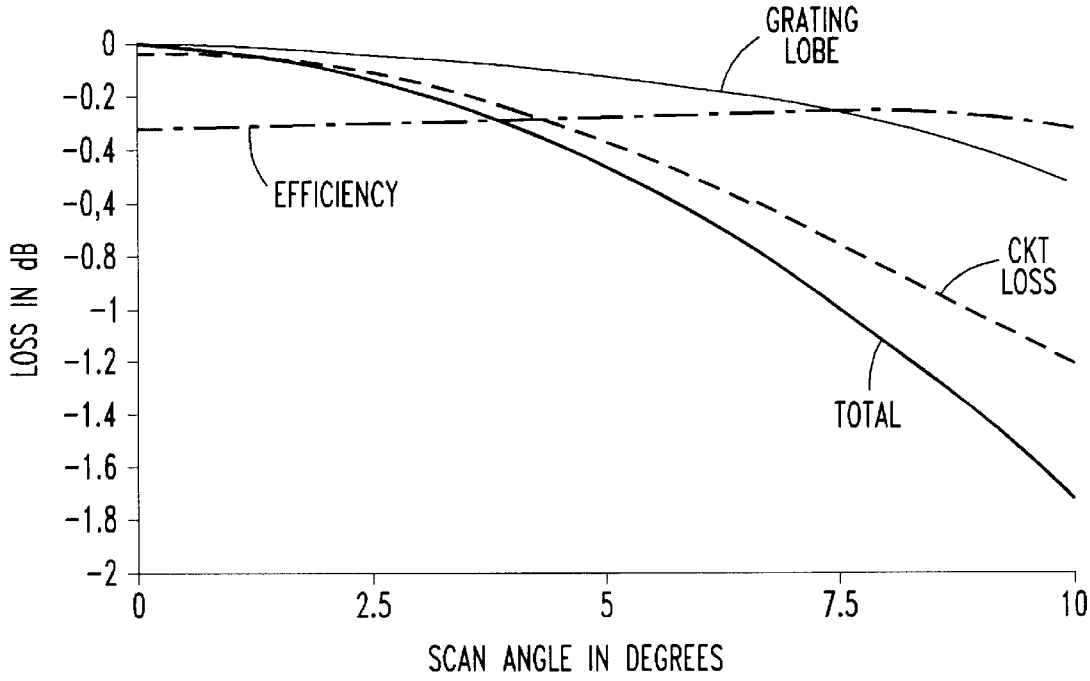
FIG. 9 is a diagram illustrative of the scan losses for scanning the hexagon array shown in FIG. 3 toward the flats of the hexagon.

FIGS. 8 and 9 are further illustrative of scan losses where FIG. 8 discloses scan losses for a scan towards points of the hexagon array shown in FIG. 3, while FIG. 9 shows the scan losses for scans towards the flats of the array shown in FIG. 3. In each instance, the grading lobe and the circuit losses total −1 dB or less for a 7.5° scan.

Accordingly, what has been shown and described is a phased array consisting of 91 antenna elements requiring only 19 feed points which is controlled by digital beam forming apparatus to generate at least 7 steered beams in a 8.7° cone about nadir. An improved feed circuit configuration consisting of a divider circuit and two types of element feeds produce overlapped sub-arrays, making it possible to fabricate a triangular element grid configuration having a hexagonal aperture which approximates a round aperture and is thus optimal for space applications where a minimal scan is required.

The foregoing detailed description merely illustrates the principles of the invention. It will thus be appreciated that those skilled in the art will be able to devise various arrangements which, although not explicitly described as shown herein, embody the principles of the invention and are thus within its spirit and scope.

What is claimed is:

1. A phased array antenna system comprising:

an array of steerable antenna elements arranged in a plurality of concentric rings and which include a plurality of digital beam forming input/output ports which are less in number than the total number of antenna elements, wherein each input/output port comprises a feed point for a respective set of mutually adjacent antenna elements including a center element and a plurality of elements which surround and form a concentric ring around the center element so as to define a plurality of sub-arrays, wherein the elements of each sub-array are selectively connected and fed from said input/output ports during transmit and receive modes so as to provide a plurality of overlapped beams.

2. An antenna system in accordance with claim 1 wherein the antenna system additionally includes a respective feed network selectively connected between each input/output port and said sub-arrays, said feed network including a plurality of sub-aperture feed ports wherein one of said plurality of sub-aperture feed ports is connected to a center element of a said sub-array and the other sub-aperture feed ports of said plurality of feed ports are selectively connected to said plurality of elements surrounding the center element of said sub-array.

3. An antenna system in accordance with claim 2 wherein the antenna elements in an outermost ring of said concentric rings are fed from a single sub-aperture feed port of said other sub-aperture feed ports of an immediately adjacent input/output port and interior elements of said concentric rings are fed from one sub-aperture feed port of two adjacent input/output ports.

4. An antenna system in accordance with claim 3 wherein said one sub-aperture feed port comprises a first power level feed port and said other sub-aperture feed ports comprise second power level feed ports.

5. An antenna system in accordance with claim 4 wherein said first power level comprises a power level greater than second power level.

6. An antenna system in accordance with claim 5, said first power is substantially equal to or equal to twice said second power level.

7. An antenna system in accordance with claim 2 wherein the plurality of concentric rings of antenna elements approximate a plurality of circular rings of antenna elements.

8. An antenna system in accordance with claim 2 wherein the plurality of concentric rings of antenna elements comprise hexagonal rings of antenna elements.

9. An antenna system in accordance with claim 2 wherein the antenna elements are further arranged in a triangular grid.

10. An antenna system in accordance with claim 2 wherein the plurality of antenna elements surrounding the center element of each sub-array approximate a circular ring of antenna elements.

11. An antenna system in accordance with claim 2 wherein the plurality of antenna elements surrounding the center element of each said sub-array comprise a hexagonal ring of antenna elements.

12. An antenna system in accordance with claim 2 wherein each said sub-array of antenna elements includes at least seven antenna elements including one center element and six elements located in a ring about the center element.

13. An antenna system in accordance with claim 12 wherein said ring of said six elements comprises a hexagonal ring located about the center element.

14. An antenna system in accordance with claim 2 wherein said input/output ports are respectively coincident with selected center elements of said sub-array.

15. An antenna system in accordance with claim 14 wherein said selected center elements comprise every other element in said concentric rings inside of the outermost concentric ring of said concentric rings.

16. An antenna system in accordance with claim 2 wherein said array of antenna elements comprises at least ninety one elements arranged in five concentric hexagonal rings.

17. An antenna system in accordance with claim 16 wherein said plurality of input/output ports comprise at least nineteen ports respectively coincident with the center elements of said sub-arrays.

18. A phased array antenna system comprising:

an array of steerable antenna elements arranged in a plurality of concentric hexagonal rings and which include a plurality of digital beam forming input/output ports, wherein each said input/output port comprises a feed point for elements of one or more sub-arrays, each sub-array including a center element and a plurality of elements which surround and form a concentric hexagonal ring around the respective center element, wherein the elements of each sub-array are selectively connected and fed from adjacent input/output ports by respective feed networks so as to provide a plurality of overlapped sub-apertures, each of said feed networks including a plurality of sub-aperture feed ports wherein one of said sub-aperture feed ports is connected to a center element of a sub-array and the other said sub-aperture feed ports are selectively connected to one or more elements surrounding the center element such that antenna elements in an outermost ring are fed from a single sub-aperture feed port of said plurality of sub-aperture feed ports and being connected from an immediately adjacent input/output port and wherein the interior elements of the concentric rings are fed from a single sub-aperture feed port of two adjacent input/output ports, thus causing overlapping beams to be generated.

19. A phased array antenna system comprising:

an array of ninety-one antenna elements arranged in five concentric hexagonal rings;

nineteen digital beam forming input/output ports, wherein each said input/output port comprises a feed point for elements of one or more sub-arrays of said antenna elements, each sub-array including a center element and six elements which surround and form a concentric hexagonal ring of elements around the center element, wherein the elements of each sub-array are selectively connected and fed from adjacent input/output ports by respective feed networks, each of said feed networks including seven sub-aperture feed ports wherein one of said seven sub-aperture feed ports is connected to a center element of a sub-array and the other six sub-aperture feed ports of said seven sub-aperture feed ports are selectively connected to the elements surrounding the center element such that antenna elements in an outermost ring are fed from one of the six sub-aperture feed ports connected from an immediately adjacent input/output port and wherein the elements of the inner concentric rings are fed from one of the six sub-aperture ports at least two adjacent input/output ports via a signal divider, whereby overlapping beams are formed by said sub-arrays.

20. An antenna system in accordance with claim 18 wherein said one sub-aperture feed port comprises a feed port providing a first power level and said six other sub-aperture feed ports comprising feed ports providing a second power level.

21. An antenna system in accordance with claim 19 wherein the first power level is substantially twice the power level as the second power level.

* * * * *